US007269990B1

(12) United States Patent
Espinosa

(10) Patent No.: US 7,269,990 B1
(45) Date of Patent: Sep. 18, 2007

(54) PORTABLE FRAME PULLER

(75) Inventor: Michael Espinosa, Wichita, KS (US)

(73) Assignee: Michael Espinosa and King's Products, Inc., Wichita, KS (US)

( * ) Notice: Subject to any disclaimer, the term of this patent is extended or adjusted under 35 U.S.C. 154(b) by 232 days.

(21) Appl. No.: 11/100,894

(22) Filed: Apr. 7, 2005

(51) Int. Cl.
*B21J 13/00* (2006.01)

(52) U.S. Cl. ..... 72/447; 72/305; 72/457; 72/705

(58) Field of Classification Search ..... 72/305, 72/447, 457, 705
See application file for complete search history.

(56) References Cited

U.S. PATENT DOCUMENTS 4,289,016 A 9/1981 Hare
4,505,145 A * 3/1985 Bergstrom et al. ..... 72/457
4,765,170 A * 8/1988 Langley et al. ..... 72/305
4,791,802 A * 12/1988 Celette ..... 72/447
5,031,438 A 7/1991 Flannery
5,509,289 A 4/1996 Narragon
5,623,846 A 4/1997 Brewer, Jr.
5,644,946 A 7/1997 Weschler
5,910,186 A 6/1999 Weschler
6,182,493 B1 2/2001 Weschler
6,216,524 B1 * 4/2001 Weschler ..... 72/457
6,779,376 B2 8/2004 Linquist

FOREIGN PATENT DOCUMENTS

GB 2027623 * 2/1980

* cited by examiner

*Primary Examiner*—Ed Tolan
(74) *Attorney, Agent, or Firm*—Quarles & Brady LLP

(57) ABSTRACT

A portable frame puller is jointed to increase the number of attachment points for fixing the frame puller relative to a vehicle being repaired and/or to reach difficult to reach pulling points. In one embodiment, the frame puller includes a pivot head pivotally connected to the main beam to easily position a clamp assembly relative to the vehicle to fix the frame puller relative to the vehicle by clamping onto the vehicle, thus eliminating the need for tie downs or anchor pot. In another embodiment, a jointed support post provides flexibility to apply pulling forces to difficult to reach attachment points on the vehicle, and a clamp assembly fixes the frame puller relative to the vehicle.

20 Claims, 9 Drawing Sheets

PORTABLE FRAME PULLER

CROSS REFERENCES TO RELATED APPLICATIONS

Not Applicable

STATEMENT REGARDING FEDERALLY SPONSORED RESEARCH

Not Applicable

TECHNICAL FIELD

This invention relates to frame pullers, more particularly, a portable frame puller having a pivot head which improves the versatility of the puller.

DESCRIPTION OF THE BACKGROUND ART

Frame pullers are used to straighten the frames and bodies of damaged vehicles. There are two general types of frame pullers: stationary frame pullers and portable frame pullers. Both of these types of frame pullers have been in use in the auto body repair industry for many years.

The stationary frame pullers include a rack on which the vehicle is positioned. These frame pullers are very versatile and can apply a variety of pulling forces from a wide range of angles. Unfortunately, stationary frame pullers are very expensive and require moving the damaged vehicle onto the rack. Moreover, many repairs to a damaged vehicle do not require applying pulling forces to difficult to reach points on the vehicle. Accordingly, the versatility of the stationary frame pullers is typically underused.

Portable frame pullers are much less expensive than stationary frame pullers, and can be moved around a vehicle being repaired. Many portable frame pullers, however, require securing the frame puller and vehicle relative to the ground using tie downs or anchor pots. This requires that the vehicle is moved to a particular location in order to perform repairs. Moreover, portable frame pullers are often limited in the directions in which a pulling force can be applied due to the frame puller construction or damage to the vehicle. As a result, portable frame pullers cannot always apply the desired pulling force that a stationary frame puller can or are as portable as desired.

SUMMARY OF THE INVENTION

The present invention provides a portable frame puller that can apply pulling forces to difficult to reach attachment points on a damaged vehicle.

One embodiment of the present invention is a portable frame puller including a horizontally extending main beam having a first end and a second end. The main beam defines a longitudinal axis extending through said first and second ends. A support post is pivotally connected to the main beam proximal the first end, wherein the support post pivots about a first pivot axis to apply a pulling force to the vehicle. A first pivot head pivotally connected to the second end includes a horizontally extending extension beam. At least one swing arm is pivotally connected to the extension beam. A clamp assembly supported by the at least one swing arm clamps onto the vehicle to fix the frame puller relative to the vehicle when applying the pulling force. In this embodiment, the frame puller includes a pivot head pivotally connected to the main beam to easily position a clamp assembly relative to the vehicle to fix the frame puller relative to the vehicle by clamping onto the vehicle, thus eliminating the need for tie downs or anchor pot.

In another embodiment, a portable frame puller includes a horizontally extending main beam having a first end and a second end, and defining a longitudinal axis extending through said first and second ends. A support post extending upwardly from the main beam proximal the first end, and including a first pivot head pivotally connecting to an extension post. One of the first pivot head and the extension post are pivotally connected to the main beam for pivotal movement about a first pivot axis transverse to the longitudinal axis. The first pivot head is pivotally connected to the extension beam for pivotal movement about a second pivot axis transverse to the first pivot axis, wherein the support post pivots about the first pivot axis to apply a pulling force to the vehicle. A first clamp assembly connected to the main beam clamps onto the vehicle to fix the frame puller relative to the vehicle when applying the pulling force. In this embodiment, a jointed support post provides flexibility to apply pulling forces to difficult to reach attachment points on the vehicle, and the clamp assembly fixes the frame puller relative to the vehicle.

In yet another embodiment, a portable frame puller includes a horizontally extending main beam having a first end and a second end, and defining a longitudinal axis extending through said first and second ends. A support post extending upwardly from the main beam proximal the first end, and includes a first pivot head pivotally connecting to an extension post. One of the first pivot head and the extension post being pivotally connected to the main beam for pivotal movement about a first pivot axis transverse to the longitudinal axis. The first pivot head is pivotally connected to the extension beam for pivotal movement about a second pivot axis transverse to the first pivot axis, wherein the support post pivots about the first pivot axis to apply a pulling force to the vehicle. A second pivot head is pivotally connected to the second end includes a horizontally extending extension beam. At least one swing arm is pivotally connected to the extension beam. A clamp assembly supported by the at least one swing arm clamps onto the vehicle to fix the frame puller relative to the vehicle when applying the pulling force. In this embodiment, a jointed support post provides flexibility to apply pulling forces to difficult to reach attachment points on the vehicle, and the clamp assembly is pivotally connected to a pivot head pivotally connected to the main to increase the number of attachment points available for fixing the frame puller relative to the vehicle.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
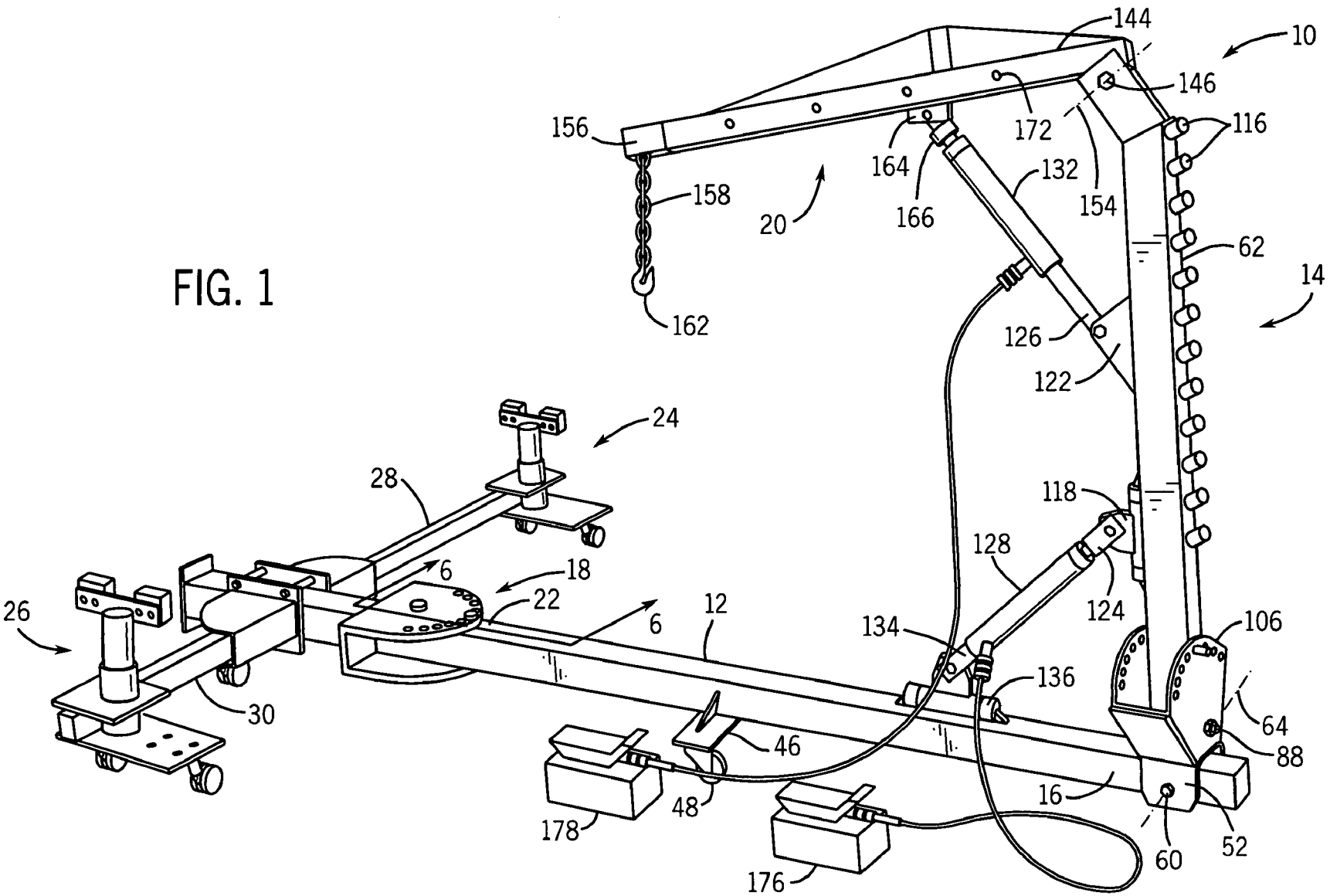
FIG. 1 is a perspective view of a portable frame puller incorporating the present invention.
Figure 2:
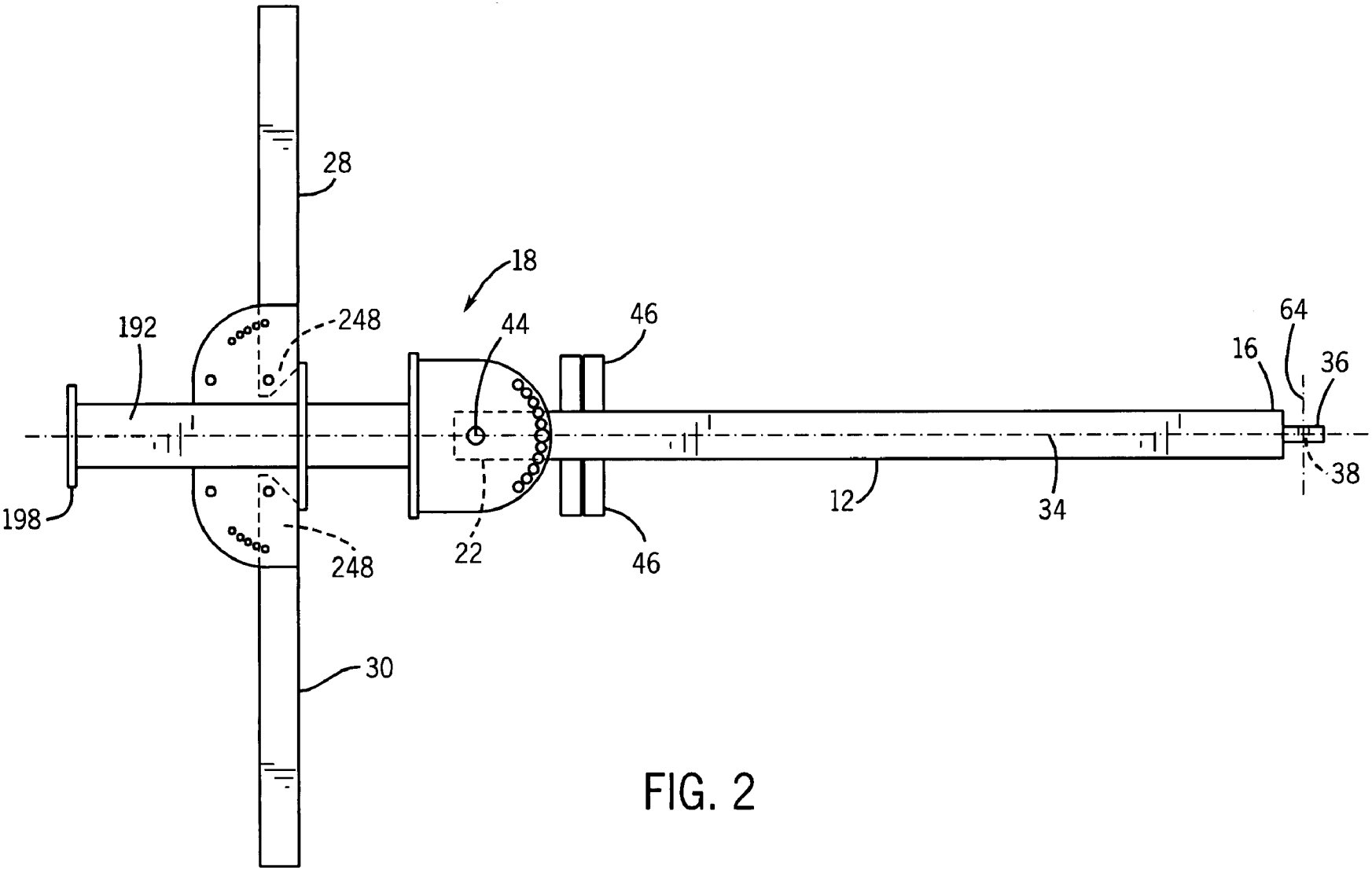
FIG. 2 is a plan view of the frame puller of FIG. 1 with the support post removed.
Figure 3:
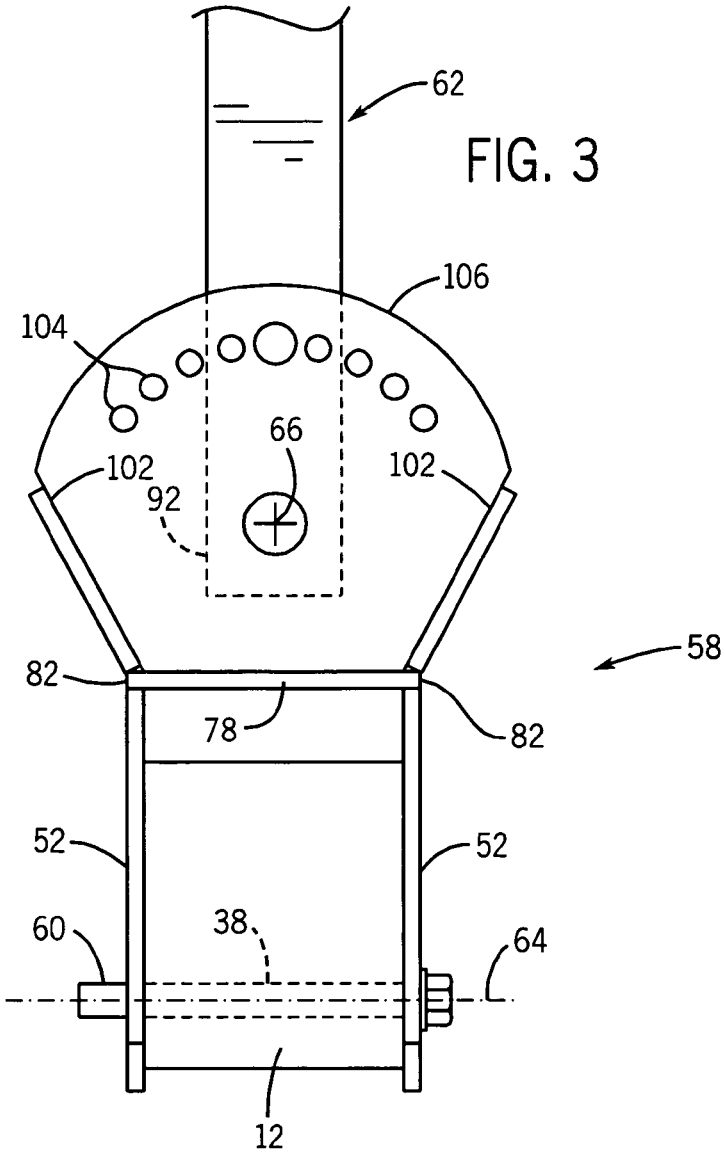
FIG. 3 is a detailed view of the support post of FIG. 1.
Figure 4:
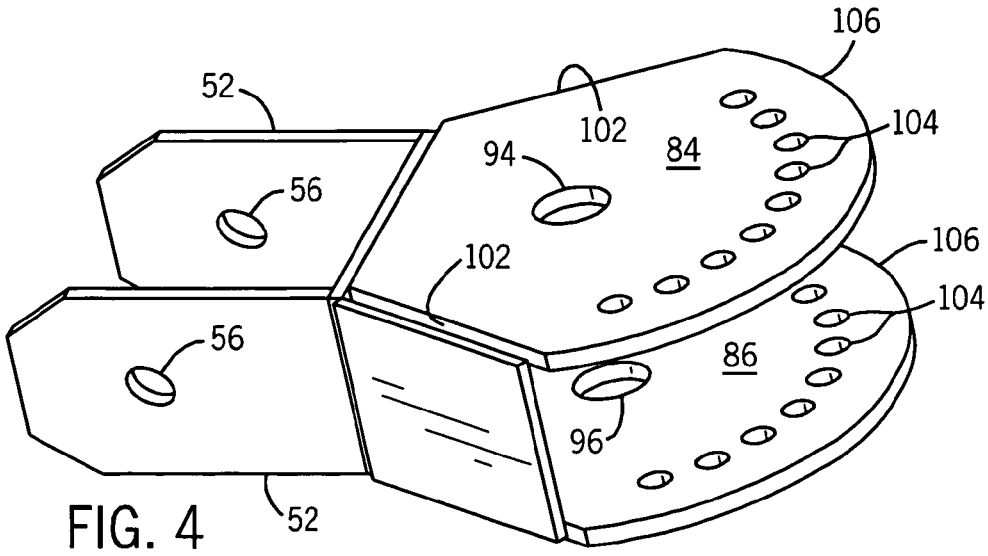
FIG. 4 is a perspective view of the post pivot head of FIG. 3.
Figure 5:
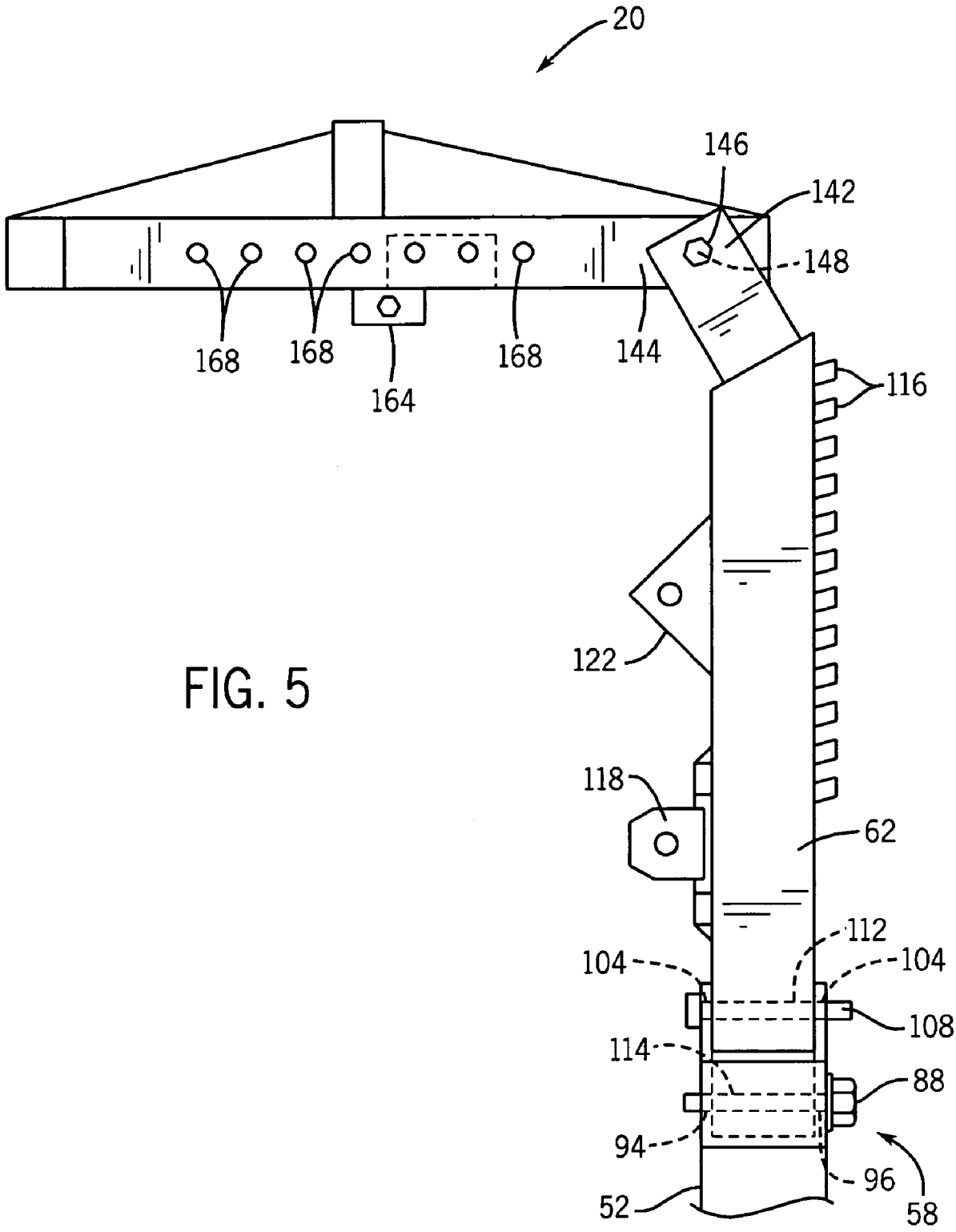
FIG. 5 is an elevation view of the support post and boom of FIG. 1.

Referring to FIGS. 1 and 2, a portable frame puller 10 incorporating the present invention includes a main beam 12 that extends horizontally beneath a vehicle being repaired. The main beam 12 pivotally supports a support post 14 that extends upwardly proximal a first end 16 of the main beam 12 and adjacent to the vehicle being repaired. The support post 14 supports a cantilevered boom 20 that extends toward the vehicle being repaired. A beam pivot head 18 pivotally connected to an opposing second end 22 of the main beam 12 pivots in a horizontal plane to align clamp assemblies 24, 26 with clamping points on the vehicle. Swing arms 28, 30 pivotally connected to the beam pivot head 18 support the clamp assemblies 24, 26 beneath the vehicle.

Figure 6:
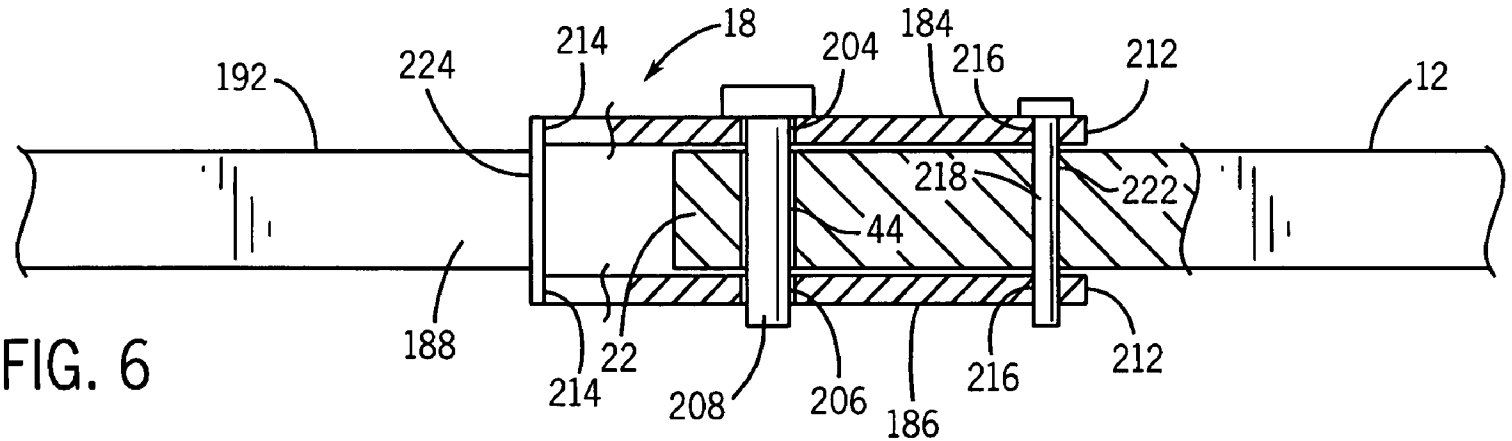
FIG. 6 is a sectional view along line 6-6 of FIG. 1.
Figure 7:
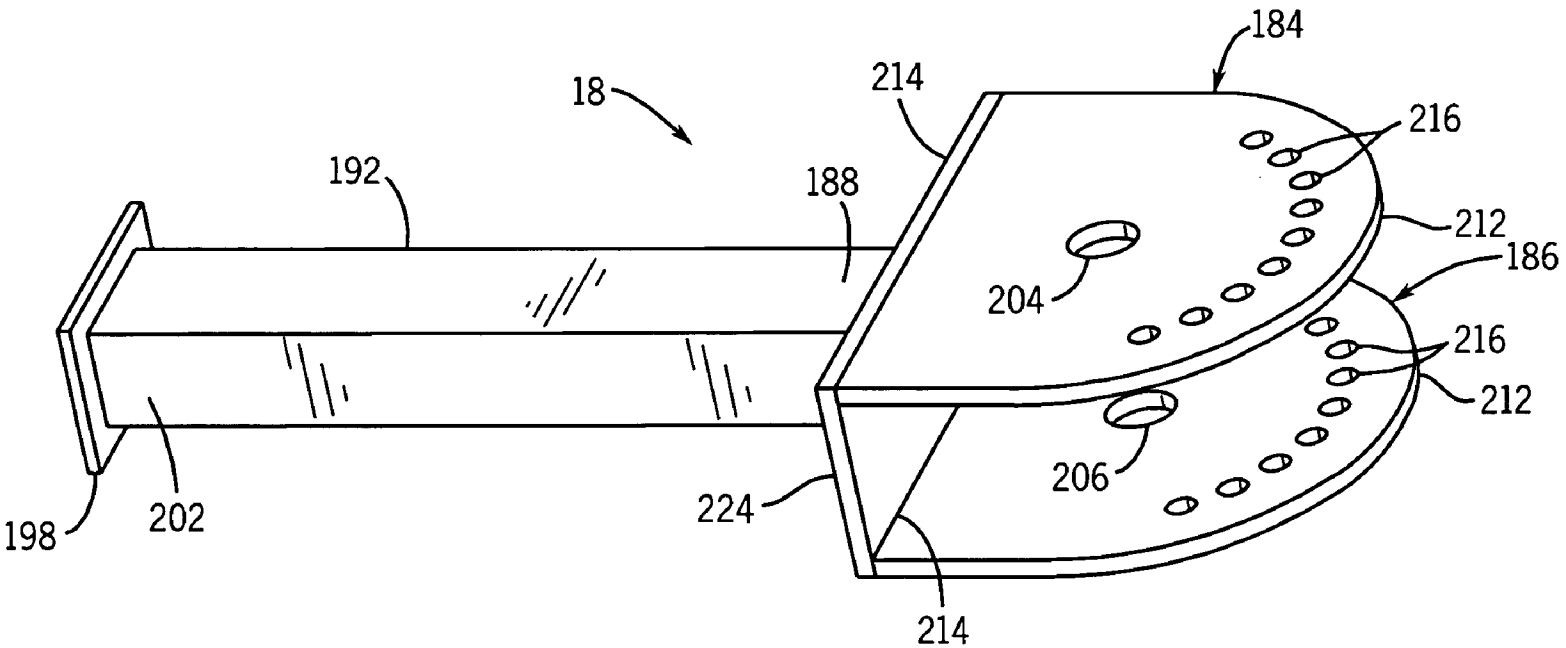
FIG. 7 is a perspective view of the beam pivot head of FIG. 1.
Figure 8:
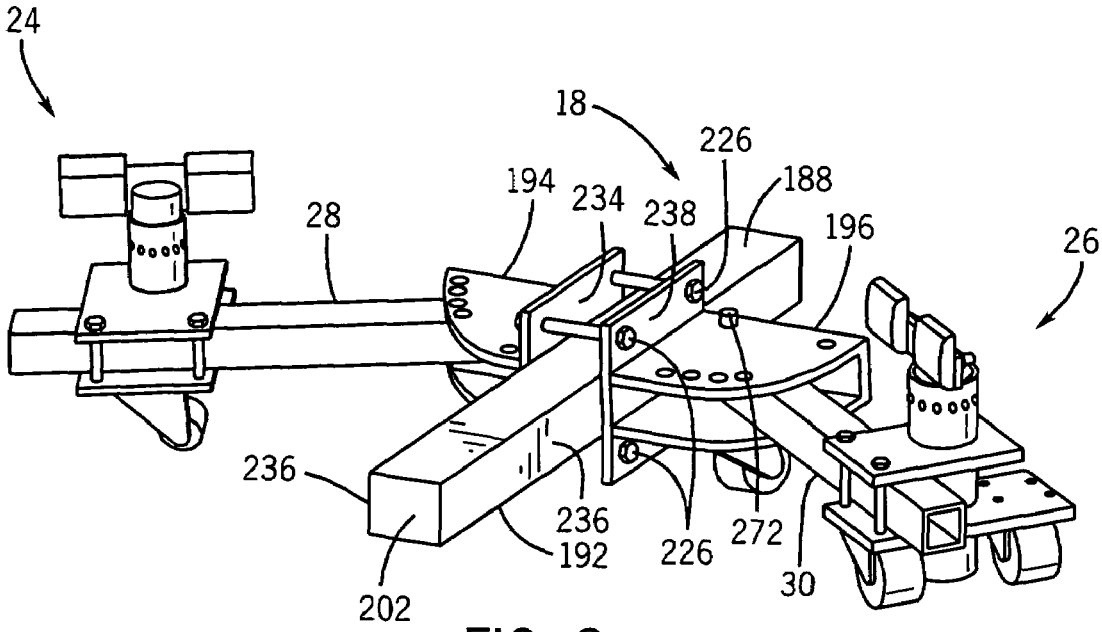
FIG. 8 is a detailed perspective view of the assembled swing arm brackets, swing arms, and clamp assemblies of FIG. 1.
Figure 9:
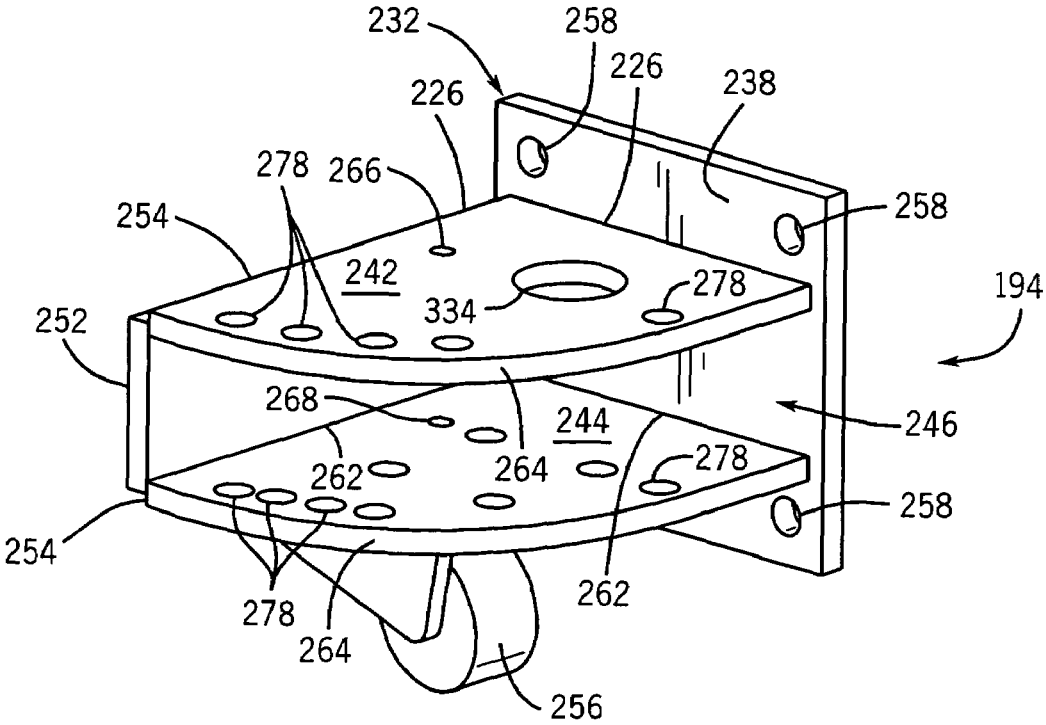
FIG. 9 is a perspective view of a swing arm bracket of FIG. 8.
Figure 10:
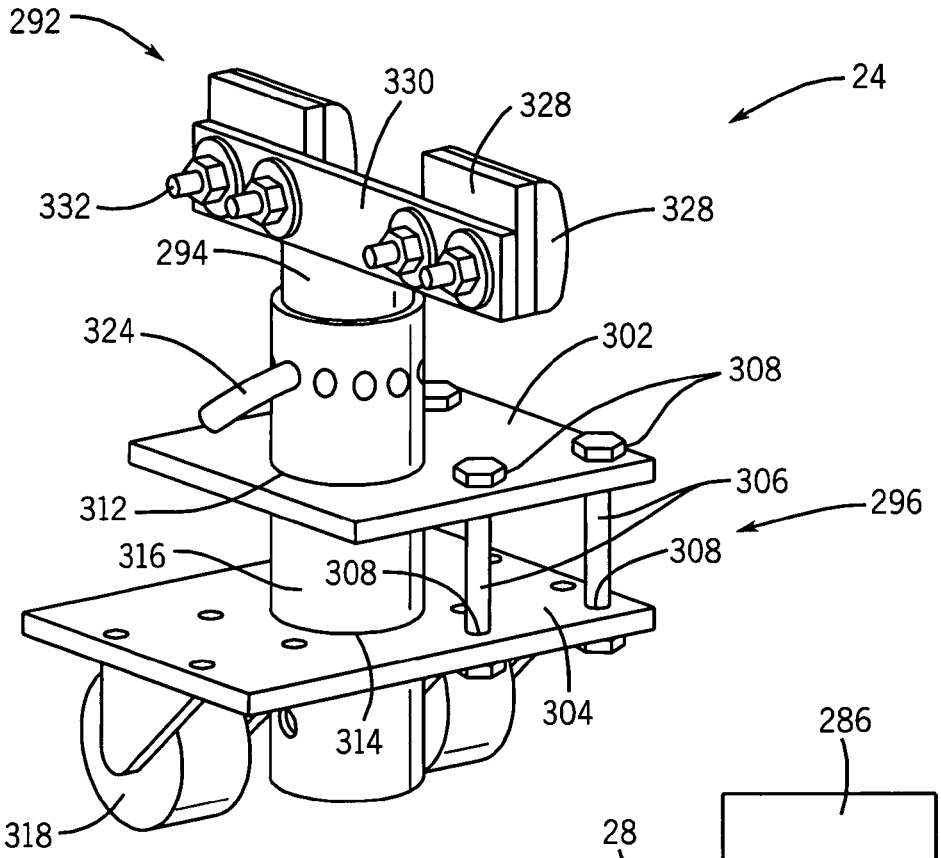
FIG. 10 is a perspective view of a clamp assembly of FIG. 8.
Figure 11:
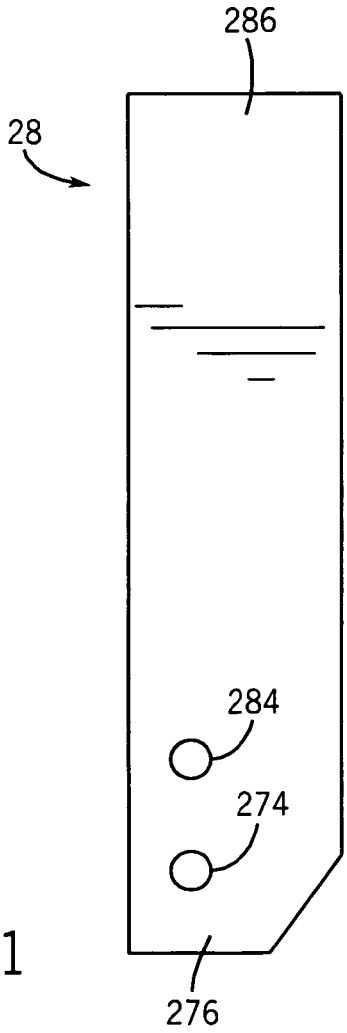
FIG. 11 is a plan view of a swing arm of FIG. 8.
Figure 12:
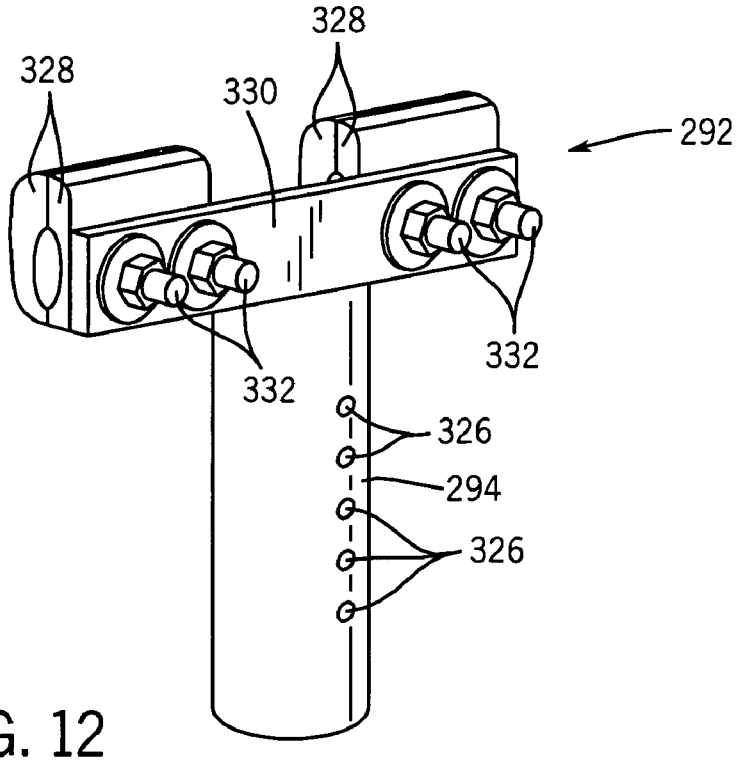
FIG. 12 is a perspective view of the clamp of FIG. 10.
Figure 13:
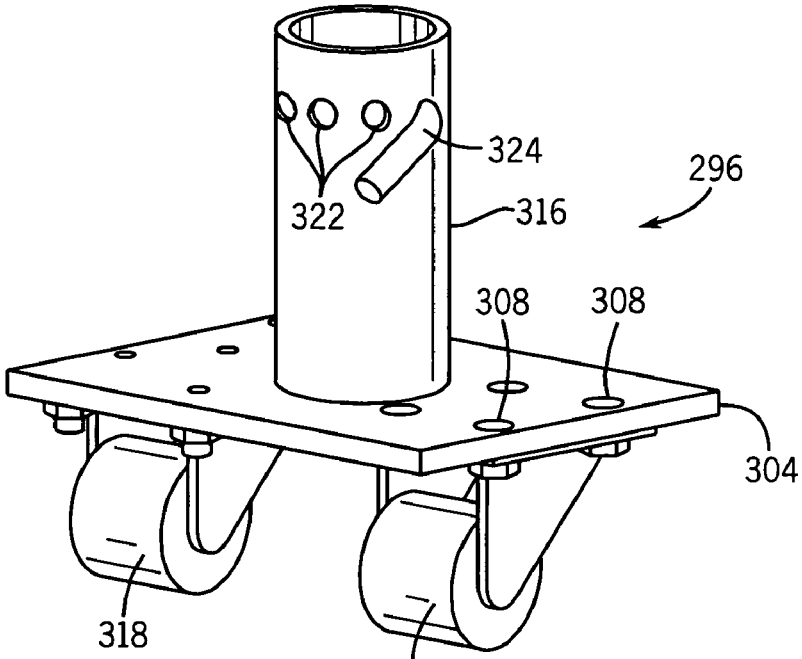
FIG. 13 is a perspective view of the clamp mounting assembly of FIG. 10 with the top plate removed.

The elongated main beam 12 is preferably formed from tube steel, and defines a longitudinal axis 34 extending through the beam first and second ends 16, 22. A transverse horizontally extending through hole 38 formed through the main beam 12 proximal the main beam first end 16 receives a pin 60 to pivotally connect the support post 14 to the main beam 12. A transverse vertically extending through hole 44 proximal the second end 22 of the main beam 12 receives a pin 208 (shown in FIG. 6) that pivotally connects the beam pivot head 18 to the main beam 12. Although forming a transverse through hole 38 through the main beam 12 for receiving the pin 60 is shown, the pin 60 can be slipped through a transverse tube fixed to an upper or lower surface of the main beam 12, such as by welding, to pivotally connect the support post 14 to the main beam 12 without departing from the scope of the invention.

Roller brackets 46 fixed to the main beam 12 and extending transversely from the main beam longitudinal axis 34 are supported by ground engaging wheels 48, or casters, that support the main beam 12 above the ground, or shop floor. Preferably, the roller brackets 46 are fixed to the main beam 12 between the midway point of the main beam 12 and the beam first end 16 to support the beam first end 16 above the ground. Additional roller brackets and rollers can be provided at any point along the main beam 12, if desired.

As shown in FIGS. 1 and 3-5, the support post 14 extends upwardly from the main beam 12 proximal to the main beam first end 16. A pair of mounting plates 52 extending downwardly from one end 54 of the support post 14 straddle the main beam 12. The pair of mounting plates 52 include coaxial through holes 56 that align with the through hole 38 formed in the main beam 12 for receiving the pin 60. The pin 60 is slipped through the aligned through holes 38, 56, and pivotally connects the support post 14 to the main beam 12 for pivotal movement in a vertical plane parallel to a pulling force applied to the vehicle by pivoting the support post 14 away from the vehicle.

Preferably, the support post 14 is jointed and includes a post pivot head 58 that pivotally connects to the main beam 12 and an extension post 62 pivotally connected to the post pivot head 58. The post pivot head 58 pivots about a horizontal pivot axis 64 transverse to the longitudinal axis 34 of the main beam 12 when applying a pulling force to the vehicle. The extension post 62 supports the boom 20, and pivots about an axis 66 transverse to the horizontal pivot axis 64 to form the jointed support post 14. Advantageously, by providing a jointed support post 14 that pivots in a direction different from the direction of the pulling force, the frame puller 10 can be configured to more easily engage the vehicle being repaired at difficult or hard to reach pulling points. Although pivotally connecting the post pivot head 58 to the main beam 12 is shown, the extension post 62 can be pivotally connected to the main beam 12 with the post pivot head 58 supporting the boom 20, or applying the pulling force directly if a boom is not provided, without departing from the scope of the invention.

The post pivot head 58 includes a pair of fan shaped hole plates 84, 86 extending from sides 78 of a back plate 74. The spaced mounting plates 52 are fixed to the back plate 74, and extend downwardly away from the back plate 74 and hole plates 84, 86 to straddle the main beam 12. One end 92 of the extension post 62 is received between a pair of fan shaped hole plate 84, 86 which support the extension post 62 at a desired angle.

Each fan shaped hole plate 84, 86 is fixed to one of the back plate sides 78, and extends from the back plate 74 away from the mounting plates 52. The hole plates 84, 86 are spaced apart to define a space 90 there between for receiving the one end 92 of the extension post 62. A through hole 94, 96 coaxially formed in each hole plate 84, 86 receives a pin 88 to pivotally connect the extension post 62 to the post pivot head 58. End plates 98 fixed to the back plate ends 82 and edges 102 of each hole plate 84, 86 can be provided to limit the pivot arc of the extension post 62. Preferably, the pivot arc is limited to 90° to prevent excessive torque forces on the post pivot head 58. Lock holes 104 formed in an arcuate pattern along an arcuate edge 106 of each hole plate 84, 86 receive a lock pin 108 that extends through a lock hole 112 formed through the extension post 62 to lock the extension post 62 at the desired angle.

The extension post 62 extends upwardly from the post pivot head 58, and pivotally supports the cantilevered boom 20. The extension post 62 is preferably, formed from tube steel, and includes a through hole 114 aligned with the coaxial through holes 98, 96 formed in each hole plate 84, 86. The pin 88 is received through the aligned holes 94, 96, 114 to pivotally connect the extension post 62 to the post pivot head 58. A plurality of pegs 116 extending from the extension post 62 away from the main beam 12 provide attachment points for a chain (not shown) that can be hooked to the vehicle being repaired for applying a pulling force on the vehicle.

Spaced apart mounting tabs 142 extending from the upper end of the support post 14 receive a proximal end 144 of the boom 20 there between. A boom pin 146 received in coaxial holes 148 formed through the mounting tabs 142 and boom proximal end 144 pivotally connects the boom 20 to the support post 14 for pivotal movement about a boom pivot axis 154 coaxial with the boom pin 146. A distal end 156 of the boom 20 includes a chain 158 having a hook 162, or other attachment device, such as a clamp, which can be secured to the vehicle to apply a pulling force to the vehicle. Advantageously, the boom 20 is easily detachable from the support post 14 by removing the boom pin 146.

The support post 14 and boom 20 are pivotally moved by hydraulic actuators 128, 132 to impart pulling forces on the vehicle being repaired. Portable hydraulic pumps 176, 178 in fluid communication with the hydraulic actuators 128, 132 are selectively operated to actuate the post and boom hydraulic actuators 128, 132. In particular, actuation of the post hydraulic actuator 128 pivots the support post 14 about the horizontal pivot axis 64. Actuation of the boom hydraulic actuator 132 pivots the boom 20 about the boom pivot axis 154.

The post hydraulic actuator 128 includes a first end 124 pivotally connected to the support post 14 by a swivel bracket 118 fixed to the support post 14. An opposing end 134 of the post hydraulic actuator 128 is pivotally connected to the main beam 12 by a swivel bracket 136 fixed to the main beam 12. Advantageously, the swivel brackets 118, 136 pivot about an axis substantially parallel to the beam 12 or post 62 to which it is attached to allow the post hydraulic actuator 128 to remain aligned with the extension post 62 as the extension post 62 pivots relative to the post pivot head 58.

The boom hydraulic actuator 132 includes a first end 126 pivotally connected to the support post by a bracket 122. An opposing end 166 of the boom hydraulic actuator is pivotally connected to the boom 320 by a slidable boom actuator bracket 164 slidably connected to the boom 20 for slidable movement between the boom ends 144, 156. The boom actuator bracket 164 is fixable at discrete points along the boom 20 to accommodate different length hydraulic actuators and for applying different pulling forces to the vehicle through the boom 20. Each discrete point is defined by a transverse hole 168 formed through the boom 20 which receives a pin 172. The pin 172 extends through a hole formed through the bracket 164 and one of the transverse holes 168 formed through the boom 20 to lock the bracket 164 at the desired discrete point.

As shown in FIGS. 1, 2, 6-9, and 11, the second end 22 of the main beam 12 which slips beneath the vehicle being repaired is pivotally connected to the beam pivot head 18. Preferably, the pivot head 18 pivots 180° relative to the main beam 12 to position the clamp assemblies relative to the vehicle for side, front, and rear pulling forces. The swing arms 28, 30 pivotally connected to the beam pivot head 18 support the clamp assemblies 24, 26 that clamp onto the vehicle being repaired to fix the frame puller 10 relative to the vehicle when applying a pulling force through the support post 14. Preferably, the swing arms 28, 30 pivot up to 90° relative to the pivot head 18 to properly position the clamp assemblies 24, 26 relative to the vehicle. Advantageously, by providing two or more clamp assemblies 24, 26 that clamp onto the vehicle, the need for additional tie downs or anchor pots that secure the vehicle against the pulling force applied by the frame puller 10 is eliminated.

The beam pivot head 18 includes a pair of spaced hole plates 184, 186 extending axially from one end 188 of an extension beam 192. Swing arm brackets 194, 196 selectively slidably mounted to the extension beam 192 pivotally connect the swing arms 28, 30 to the beam pivot head 18. A cap 198 fixed to an opposing end 202 of the extension beam 192 prevents the swing arm brackets 194, 196 from sliding off of the opposing end 202 of the extension beam 192.

The spaced hole plates 184, 186 straddle the second end 22 of the main beam 12 to pivotally connect the beam pivot head 18 to the main beam 12. A pivot hole 204, 206 formed through each hole plate 184, 186 receives a pivot pin 208. The pivot pin 208 pivotally connects the beam pivot head 18 to the main beam 12 by extending through the through hole 44 formed through the main beam 12 and the pivot holes 204, 206.

Each hole plate 184, 186 includes an arcuate edge 212 joined to a straight edge 214. The arcuate edge 212 defines an arc substantially coaxial with the pivot holes 204, 206. Lock holes 216 spaced radially inwardly from the arcuate edge 212 receives a lock pin 218 that extends into a lock hole 222 formed in the main beam 12 to lock the beam pivot head 18 at discrete angles relative to the main beam 12. The straight edge 214 of each hole plate 184, 186 is fixed to a back plate 224, such as by welding. The back plate 224 is fixed to the one end 188 of the horizontal extension beam 192 extending horizontally away from the main beam 12.

The swing arm brackets 194, 196 are bolted together, using bolts 226, and sandwich the extension beam 192 there between to selectively fix the swing arm brackets 194, 196 to the extension beam 192. Advantageously, the bolts 226 can be loosened to slide the swing arm brackets 194, 196 along the length of the extension beam 192 to properly position the swing arms 28, 30 and, thus the clamp assemblies 24, 26 supported by the swing arms 28, 30, relative to the vehicle being repaired. Although fixing the swing arm brackets 194, 196 together, such that the swing arm brackets 194, 196 can be slidably moved relative to the extension beam 192 is preferred, other methods for fixing each swing arm bracket 194, 196 relative to the extension beam 192, such as welding, bolting direct, independently clamping, and the like can be used.

Each swing arm bracket 194, 196 pivotally connects one of the swing arms 28, 30 relative to the beam pivot head 18. Preferably, each swing arm bracket 194, 196 includes a mounting plate 232 having an inner face 234 abutting a vertical side 236 of the extension beam 192 and an outer face 238. Upper and lower, vertically spaced, pie-shaped hole plates 242, 244 joined, such as by welding, to the outer face 238 of the mounting plate 232 define a space 246 there between for receiving an end 248 of one of the swing arms 28, 30. A back plate 252 fixed, such as by welding, to an edge 254 of each hole plate 242, 244 maintains the space 246 between the hole plates 242, 244, and provide a stop for the swing arm 28, 30 received in the space 246 from pivoting beyond a predetermined angle relative to the mounting plate 232, and thus the extension beam 192. A ground engaging roller 256, or caster, fixed, such as by bolts, to each lower hole plate 244, supports the swing arm bracket 194, 196, and thus the pivot head 18 and second end 22 of the main beam 12, above the ground.

The mounting plates 232 extend above and below the extension beam 192, and include holes 258 in the portions of the mounting plates 232 extending above and below the extension beam 192 for receiving the bolts 226 there through. The bolts 226 extend transverse to the extension beam 192 and clamp the extension beam 192 between the mounting plates 232 to secure the mounting plates 232, and thus the swing arm brackets 194, 196 to the extension beam 192.

The pie shaped hole plates 242, 244 of each swing arm bracket 194, 196 include adjacent straight edges 262 joined by an arcuate edge 264. One of the straight edges 262 of each hole plate 242, 244 is joined, such as by welding, to the outer face 238 of the mounting plate 232. The back plate 252 joins the adjacent straight edges 262 of the hole plates 242, 244. Coaxial holes 266, 268 formed through the hole plates 242, 244 receive a pivot pin 272 extending through a through hole 274 formed through the proximal end 276 of the swing arm 28, 30 to pivotally connect the swing arm 28, 30 to the swing arm bracket 194, 196. Lock holes 278 spaced radially inwardly from the arcuate edge 264 of each pie shaped hole plate 242, 244 receive a lock pin 282 that extends into a lock hole 284 formed in the swing arm 28, 30 to lock the swing arm 28, 30 at discrete angles relative to the mounting plate 232, and thus the extension beam 192.

Each swing arm 28, 30 is pivotally connected to the extension beam 192 by one of the swing arm brackets 194, 196, and connects one of the clamp assemblies 24, 26 to the beam pivot head 18. Preferably, the swing arms 28, 30 are formed from steel tube having the proximal end 276 and a distal end 286. The proximal end 276 is pivotally connected to the swing arm bracket 194, 196 and by the pin 272 and is chamfered to avoid interference with the swing arm bracket 194, 196 when pivoting.

The clamp assembly 24,26 is mounted at any point along the length of the swing arm 28, 30 to position the clamp assembly 24, 26 relative to the vehicle being repaired. In the embodiment disclosed herein, each clamp assembly 24, 26 secured to one of the swing arms 28, 30 includes a pinch weld clamp 292 having a vertically extending inner tube 294 and a clamp mounting assembly 296. The clamp mounting assembly 296 secures the pinch weld clamp 292 to the swing arm 28, 30. Of course, any clamp assembly that can clamp onto a vehicle and be secured to the swing arm 28, 30 can be used without departing from the scope of the invention.

As shown in FIGS. 1, 8, 10, 12, and 13, the clamp mounting assembly 296 includes a top plate 302 extending over the swing arm 28, 30 and a base plate 304 extending beneath the swing arm 28, 30. Vertically extending bolts 306 received in aligned holes 308 formed through the top and base plate 302, 304 sandwich the swing arm 28, 30 between the base and top plates 304, 302 to secure the clamp mounting assembly 296 to the swing arm 28, 30. A portion of the base and top plates 304, 302 extend laterally beyond the swing arm 28, 30 and include aligned apertures 312, 314 coaxial with a mounting tube 316. Rollers 318, or casters, fixed to the base plate 304 support the clamp mounting assembly 296, and thus the distal end 286 of the swing arm 28, 30, above the ground.

The mounting tube 316 is fixed to one of the base and top plates 304, 302, such as by welding, and is slidably movable relative to the other of the base and top plates 304, 302. Pairs of aligned holes 322 are formed through the mounting tube 316. A pin 324 extending through any pair of aligned holes 322 and a hole 326 formed through the inner tube 294 of the clamp 292 locks the inner tube 294 relative to the mounting tube 316.

The clamp 292 extends upwards from the mounting tube 316 and includes opposing jaws 328 mounted to a T-Bar 330 fixed to and extending transverse to the inner tube 294. Bolts 332 secure the jaws 328 to the T-bar 330 and tighten the jaws 328 onto the vehicle being repaired. The inner tube 294 telescopes out of the mounting tube 316 and includes a plurality of through holes 326 spaced along the length of the inner tube 294. One of the plurality of through holes 326 is aligned with one pair of the aligned holes 322 formed through the mounting tube 316 to position the clamp 292 at a desired height and degree of rotation. The pin 324 extending through the selected pair of aligned holes 322 and the selected hole 326 through the inner tube 294 locks the clamp 292 at the desired height and degree of rotation.

Figure 14:
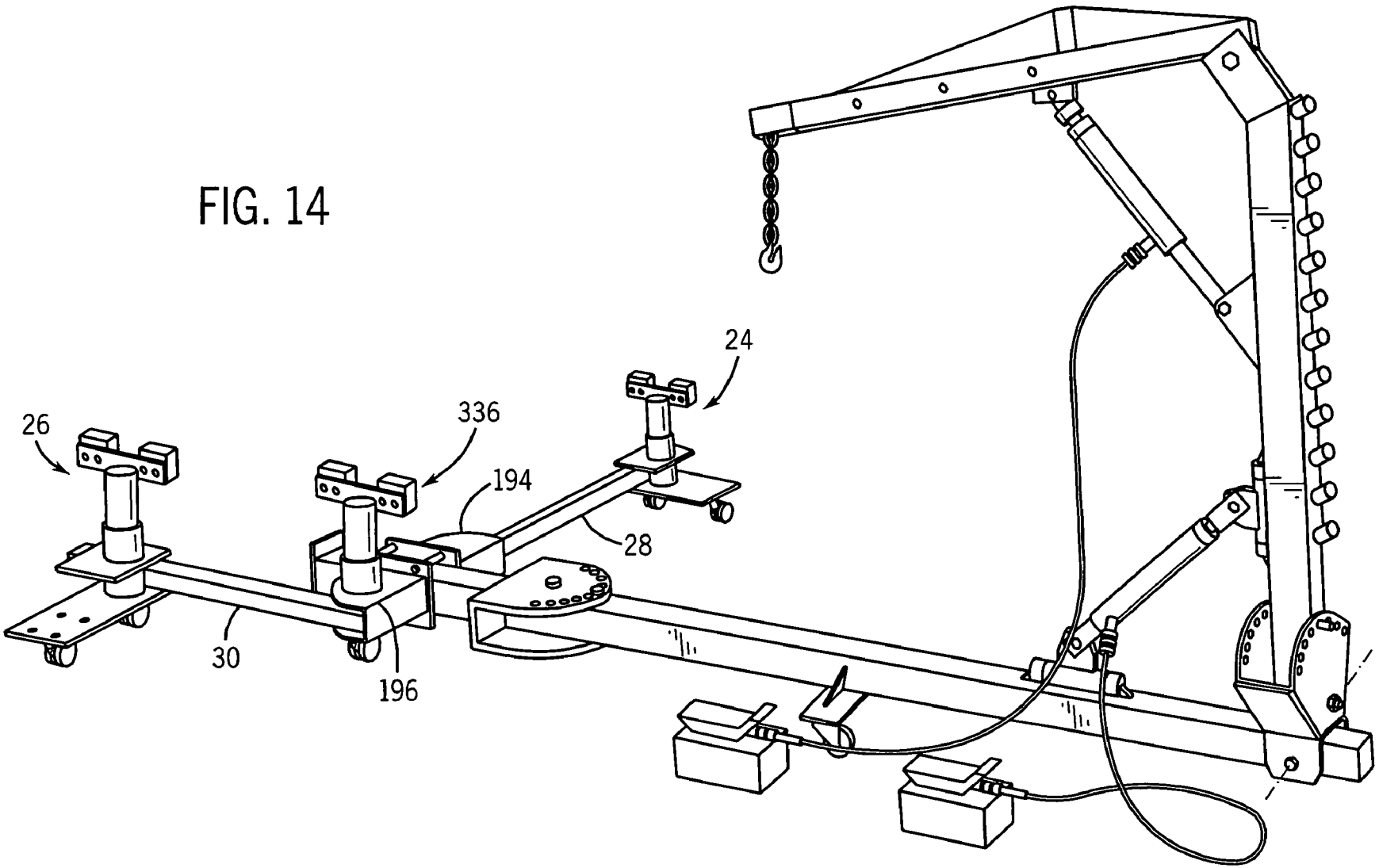
FIG. 14 is a perspective view of an alternative embodiment of a portable frame puller incorporating the present invention including an additional clamp installed.

In an alternative preferred embodiment shown in FIG. 14, the swing arm brackets 194, 196 include a clamp mounting aperture 334 formed in the hole plates 242, 244 for receiving an inner tube 294 of an additional clamp assembly 336. The additional clamp assembly 336 clamps onto the vehicle at an additional attachment point to more securely fix the frame puller 10 relative to the vehicle when applying a large pulling force.

Referring now to FIGS. 1-13, in use, the frame puller 10 is positioned with the main beam 12 extending beneath the vehicle being repaired. The beam pivot head 18 and swing arms 28, 30 are adjusted to position the clamps 292 beneath desired attachment points. The clamps 292 are clamped onto the attachment points and locked relative to the respective clamp mounting assemblies 296 to secure the frame puller 10 relative to the vehicle at two points. If required, the additional clamp assembly 336 can be inserted into the clamp mounting aperture 334 in one of the swing arm brackets 194, 196 to fix the frame puller 10 relative to the vehicle at a third attachment point.

Once the frame puller 10 is secured relative to the vehicle, the support post 14 is positioned relative to the vehicle by pivoting the extension post 62 about the axis 66 transverse to the horizontal pivot axis 64 and locking the extension post 62 relative to the pivot head. The chain 158 extending from the boom 20 is then attached to a point on the vehicle which is to be pulled. One of the post and boom hydraulic actuators 128, 132 is then actuated to apply a pulling force to the point on the vehicle which is to be pulled.

While there has been shown and described what are at present considered the preferred embodiment of the invention, it will be obvious to those skilled in the art that various changes and modifications can be made therein without departing from the scope of the invention.

I claim:

1. A portable frame puller for repairing a damaged vehicle, said frame puller comprising:

a horizontally extending main beam having a first end and a second end, and said main beam defines a longitudinal axis extending through said first and second ends;

a support post pivotally connected to said main beam proximal said first end, wherein said support post pivots about a first pivot axis to apply a pulling force to the vehicle;

a first pivot head pivotally connected to said second end, and including a horizontally extending extension beam;

at least one swing arm pivotally connected to said extension beam; and a clamp assembly supported by said at least one swing arm for clamping onto the vehicle to fix the frame puller relative to the vehicle when applying the pulling force.

2. The frame puller as in claim 1, in which said support post supports a boom arm.

3. The frame puller as in claim 1, in which said clamp assembly is a pinch weld clamp assembly which clamps onto a pinch weld of the vehicle.

4. The frame puller as in claim 1, in which said extension beam forming part of said first pivot head includes a first side and an oppositely facing second side, and said at least one swing arm includes a first swing arm pivotally connected to said first pivot head and extending horizontally from said first side and a second swing arm pivotally connected to said first pivot head and extending horizontally from said second side.

5. The frame puller as in claim 1, in which said at least one swing arm is pivotally connected to said extension beam by a swing arm bracket fixed to said pivot head.

6. The frame puller as in claim 5, in which a said swing arm bracket supports another clamp assembly which clamps onto the vehicle.

7. The frame puller as in claim 1, in which said first pivot axis is transverse to said longitudinal axis.

8. The frame puller as in claim 7, in which said support post includes a second pivot head and vertically extending extension post, one of said second pivot head and extension post being pivotally connected to said main beam for pivotal movement about the first pivot axis, and said second pivot head and said extension post being pivotally connected for pivotal movement about a second pivot axis transverse to said first pivot axis.

9. The frame puller as in claim 1, in which said support post is pivoted by a hydraulic actuator.

10. A portable frame puller for repairing a damaged vehicle, said frame puller comprising:

a horizontally extending main beam having a first end and a second end, and defining a longitudinal axis extending through said first and second ends;

a support post extending upwardly from said main beam proximal said first end, and including a first pivot head pivotally connecting to a vertically extending extension post, one of said first pivot head and said extension post being pivotally connected to said main beam for pivotal movement about a first pivot axis transverse to said longitudinal axis, and said first pivot head being pivotally connected to said extension post for pivotal movement about a second pivot axis transverse to said first pivot axis, wherein said support post pivots about said first pivot axis to apply a pulling force to the vehicle, said first pivot head having lock holes for locking said extension post at a desired angle; and a first clamp assembly connected to said main beam for clamping onto the vehicle to fix the frame puller relative to the vehicle when applying the pulling force.

11. The frame puller as in claim 10, including a second pivot head pivotally connected to said second end, and including a horizontally extending extension beam;

a first swing arm supporting said first clamp assembly and pivotally connected to one side of said extension beam;

a second swing arm pivotally connected to an opposing side of said extension beam; and a second clamp assembly supported by said second swing arm for clamping onto the vehicle.

12. The portable frame puller as in claim 11, in which said support post supports a boom arm.

13. The portable frame puller as in claim 11, in which at least one of said clamp assemblies is a pinch weld clamp assembly which clamps onto a pinch weld of the vehicle.

14. The frame puller as in claim 11, in which at least one of said swing arms is pivotally connected to said second pivot head by a swing arm bracket fixed to said extension beam.

15. The frame puller as in claim 14, in which said swing arm bracket supports another clamp assembly which clamps onto the vehicle.

16. The frame puller as in claim 11, in which said support post is pivoted by a hydraulic actuator.

17. A portable frame puller for repairing a damaged vehicle, said frame puller comprising:

a horizontally extending main beam having a first end and a second end, and defining a longitudinal axis extending through said first and second ends;

a support post extending upwardly from said main beam proximal said first end, and including a first pivot head pivotally connecting to a vertically extending extension post, one of said first pivot head and said extension post being pivotally connected to said main beam for pivotal movement about a first pivot axis transverse to said longitudinal axis, and said first pivot head being pivotally connected to said extension post for pivotal movement about a second pivot axis transverse to said first pivot axis, wherein said support post pivots about said first pivot axis to apply a pulling force to the vehicle; and a second pivot head pivotally connected to said second end, and including a horizontally extending extension beam;

at least one swing arm pivotally connected to said extension beam; and a clamp assembly supported by said at least one swing arm for clamping onto the vehicle to fix the frame puller relative to the vehicle when applying the pulling force.

18. The frame puller as in claim 17, in which said at least one swing arm is pivotally connected to said second pivot head by a swing arm bracket fixed to said extension beam.

19. The frame puller as in claim 18, in which said swing arm bracket supports another clamp assembly which clamps onto the vehicle.

20. The frame puller as in claim 17, in which said at least one swing arm is pivotally connected to one side of said extension beam, and a second swing arm is pivotally connected to an opposing side of said extension beam, said second swing arm supporting a second clamp assembly for clamping onto the vehicle.

* * * * *